US011078716B2

(12) United States Patent
De Sousa Guedes

(10) Patent No.: US 11,078,716 B2
(45) Date of Patent: Aug. 3, 2021

(54) REMOVABLE PROFILE STRUCTURE

(71) Applicant: JOFEBAR, S.A., Perafita-Matosinhos (PT)

(72) Inventor: Jose Fernando De Sousa Guedes, Perafita-Matosinhos (PT)

(73) Assignee: JOFEBAR, S.A.

( * ) Notice: Subject to any disclaimer, the term of this patent is extended or adjusted under 35 U.S.C. 154(b) by 0 days.

(21) Appl. No.: 16/300,470

(22) PCT Filed: May 12, 2016

(86) PCT No.: PCT/PT2016/000004

§ 371 (c)(1),
(2) Date: Nov. 9, 2018

(87) PCT Pub. No.: WO2017/196197

PCT Pub. Date: Nov. 16, 2017

(65) Prior Publication Data

US 2019/0169921 A1 Jun. 6, 2019

(51) Int. Cl.
*E06B 3/46* (2006.01)
*E05D 15/06* (2006.01)

(52) U.S. Cl.
CPC ..... *E06B 3/4609* (2013.01); *E05D 15/0656* (2013.01); *E05D 15/0686* (2013.01); *E05Y 2800/205* (2013.01); *E05Y 2900/148* (2013.01)

(58) Field of Classification Search
CPC ..... E05D 15/0682; E05D 15/0686; E05D 15/0656; E06B 3/4609; E06B 1/6053; E06B 3/46
See application file for complete search history.

(56) References Cited

U.S. PATENT DOCUMENTS 3,861,444 A * 1/1975 Portwood ..... E06B 3/4609 160/90
4,265,052 A * 5/1981 Johnson ..... E06B 1/58 49/404
4,455,709 A * 6/1984 Zanini ..... E05D 15/0656 16/90
5,321,911 A * 6/1994 Dickinson ..... E06B 3/20 16/96 R
7,555,871 B1 * 7/2009 Neal ..... E05D 15/0621 49/409
2007/0234657 A1 10/2007 Speyer et al.
2012/0005975 A1 1/2012 Kim
2012/0291392 A1 11/2012 Joray
2015/0240552 A1 * 8/2015 Kim ..... E05D 15/0665 49/411

OTHER PUBLICATIONS

International Search Report and Written Opinion dated Dec. 20, 2016, relating to corresponding Application No. PCT/PT2016/000004.

* cited by examiner

*Primary Examiner* — Gisele D Ford
(74) *Attorney, Agent, or Firm* — Womble Bond Dickinson (US) LLP; John J. Penny, Jr.

(57) ABSTRACT

The present invention relates to a removable profile structure, primarily for sliding panels, comprising a concealed support (2) with an inverted "U" shape which comprises at least two rectangular sections (3) and a "W" shaped detachable base (1) able to receive a glass (4).
This solution, in which the concealed support (2) and the detachable base (1) are independent, allows the removal of the sliding panel without interfering with the state of the pavement coating.

6 Claims, 3 Drawing Sheets

REMOVABLE PROFILE STRUCTURE

The present application claims priority 35 U.S.C. § 365 to PCT/PT2016/000004, filed on May 12, 2016, the disclosure of which is incorporated herein by reference.

Actually there are numerous solutions for the construction of windows and doors for large spans and that can be divided into two large groups: sliding structures and opening structures. Each solution has its advantages and disadvantages in terms of manufacturing costs, durability, sealing systems, etc.

In what concerns the sliding structures, and to meet the architects will, it relate to the necessity of the rails supporting the mobile structure, especially at floor level, being too large, of creating the possibility of being partially covered to lessen the visual impact to the user. This challenge increases with the size of the moving structures, as, for constructive reasons, the large windows/doors have necessarily a considerable weight, requiring robust rails with considerable size and strong visual impact in order not to compromise the quality and durability of the final product.

STATE OF THE ART

The sliding windows or doors consist basically in a sliding structure containing the glasses and a structure attached to the building consisting in hoops, usually perpendicular to each other, forming a closed structure. The hoops that normally support the weight are often called the rail, which in addition to supporting all the weight of the sliding structure should also work as a guide in the opening and closing of the window/door. Accordingly, in large windows/doors the rail turns out to be fairly large, making a significant visual impact on the user.

Manufacturers of this type of structures have proposed several solutions over the years, either by changing the shape of the rails, or by creating solutions that try to reduce the visual impact of the rail, covering it partially. One example of these solutions is disclosed in Patent PT2361339 in which the bearings are incorporated in the rails (see FIG. 4). Another way of solving this drawback is disclosed in U.S. Patent US2012/0291392A1 proposing the extension of the pavement over the rails and the use of additional parts to cover almost completely the rails and thereby obtaining a quite satisfactory result in terms of visual impact of the rails without compromising its structural characteristics.

This solution, although solving quite well the problem of the visual impact of the rails, raises another not minor difficulty; in case of breakage or malfunction of the glasses it is necessary to remove the pavement (7), which is usually time consuming and expensive.

The object of the present invention is to resolve this drawback by proposing a solution allowing the removal of the sliding structure (window or door) without being necessary to remove the pavement (or portion thereof) that covers the rail.

This effect is achieved through a new sliding structure consisting of two independent parts, a concealed support and a detachable base, wherein the concealed support (2) slides on the bearings of the base structure (8) and the detachable base (1) is part of the sliding structure and serves as a support for the glass elements (4).

For an easier understanding of the invention it follows a description of the figures that represent preferred embodiments of the invention that, however, are not intended to limit the scope of the present invention.

DESCRIPTION OF THE MAIN COMPONENTS

Figure 1:
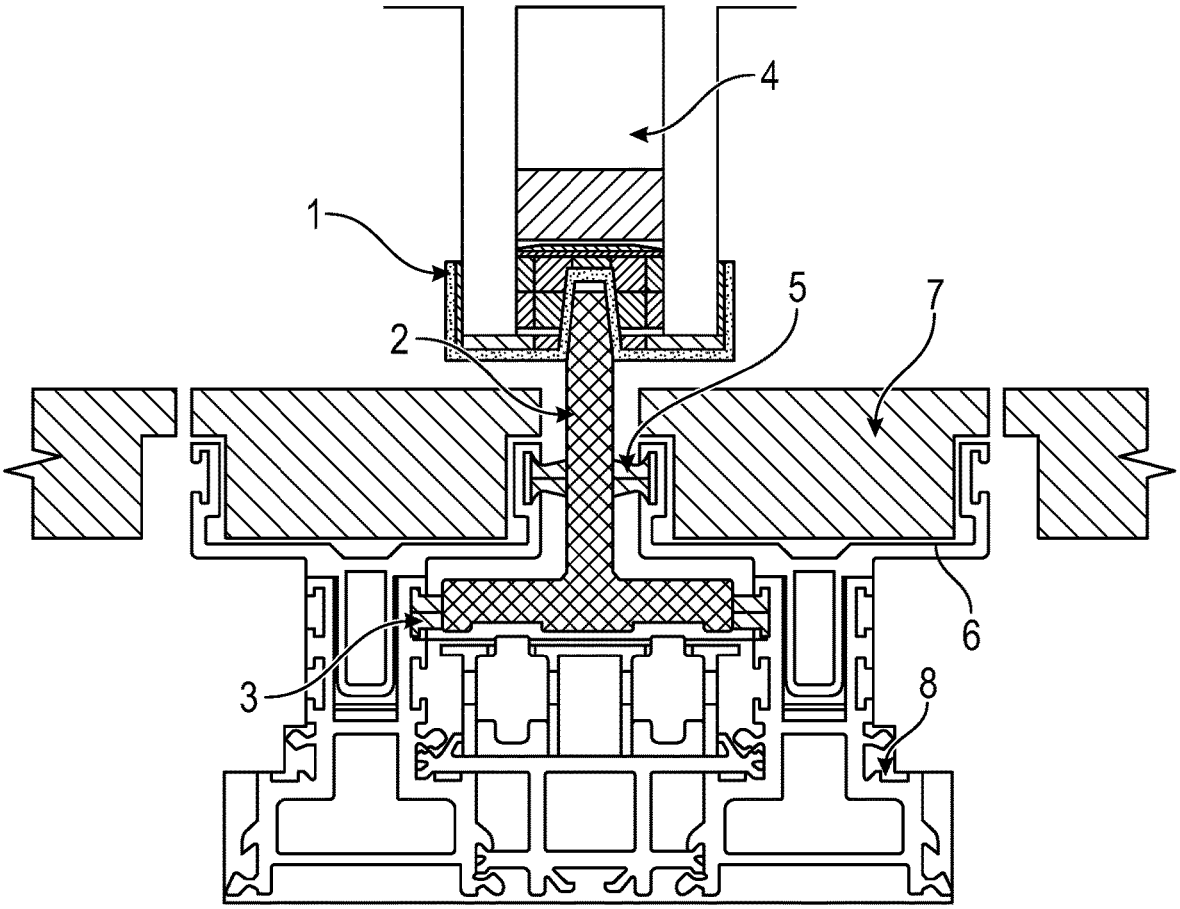
FIG. 1 shows the removable profile structure in the fitted position where it can be seen that the detachable base (1) rests on the concealed support (2), wherein the top of the latter does not contact the base (1).
Figure 2:
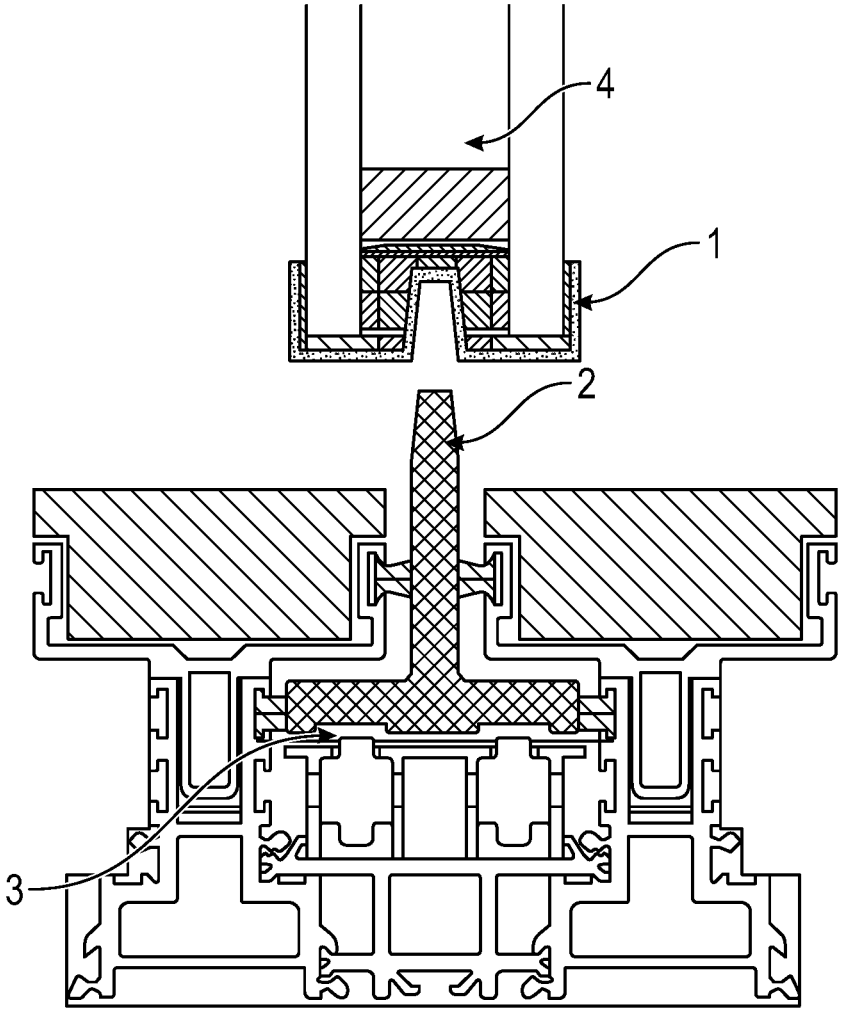
FIG. 2 shows the removable profile structure in the disengaged position. It is apparent that only the detachable base (1) separates itself from the remaining set, the set remaining unchanged.
Figure 3:
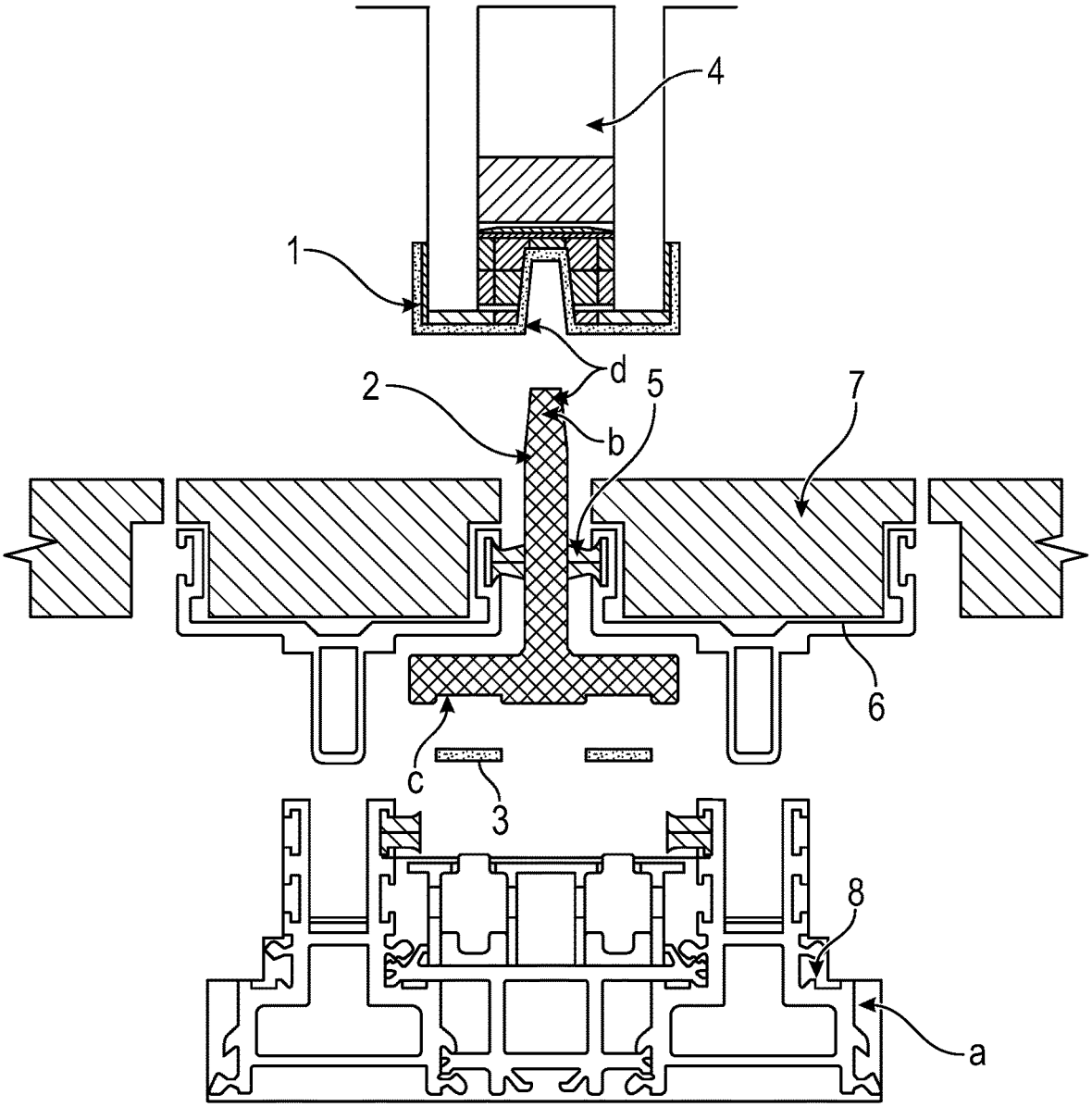
FIG. 3 highlights the contact areas (d) between the detachable base (1) and the concealed support (2) and also the rectangular sections (3) that are coupled in the recesses (c) of the support.

1—detachable base;
2—concealed support;
  a. Concealed base;
  b. Protuberance;
  c. Recesses;
  d. Contact area;
3—rectangular sections;
4—glass;
5—plush;
6—removable pavement carrier;
7—pavement;
8—structure of the concealed base (fixed).

DETAILED DESCRIPTION OF THE INVENTION

As referred above, one of the solutions to reduce the visual impact of the rail consist of the extension of the floor of the space where the windows or doors are to be installed, thus covering part of it.

Nowadays, and according to the state of the art, in order to replace a damaged glass it is necessary to previously remove the applied pavement (7), which greatly increases the costs and repair times.

Given the state of the art herein described, a solution has been searched that would allow the removal of the sliding structure without having to remove the pavement, without compromising the robustness of the sliding structures or fixed structure.

The solution consists in dividing the sliding structure into two sections (1 and 2) which can easily be separated using simple tools and thus allowing the removal of the section (1) without having to remove the pavement (7) or other parts placed to cover the fixed rail (8), because the part (2) of the sliding structure will remain under the pavement and in contact with the fixed rail (8).

This solution resulted in the development of two independent parts, which will be hereinafter designated by Concealed Support (2) and Detachable Base (1).

After development and extensive testing, we have come to the conclusion that the optimal configuration of the Concealed Support (2) in order to support the weight of the Detachable Base (1) and simultaneously to serve as a guide for the opening and closing of the structure should be the one presented in FIG. 1, and which consists essentially of a base containing two recesses (C) for the engagement of the rectangular sections (3) with the bearings, and a protuberance (B) with the top having a shape of an inverted "U". This area (excluding the top of the support) will serve as the contact area (D) to receive the fit with a "W" shape of the detachable base (1).

This structure proved to have the necessary stability to a good performance of the detachable base (1), as well as an extreme durability under extreme conditions of operation. The contact surfaces between the two profiles are smooth, in order not to hinder the separation of the elements, but the incline of the faces of the profiles (1) and (2) produces a gradual increase in stability which is necessary for the connection between the profiles, the larger the panel and therefore its weight. The fact that the detachable base (1) and the concealed support (2) come together in a calliper forming gives the assembly a greater stability, the resistance of the concealed support (2) also providing the assembly with a smoother operation due to a better planimetry arising from its section, dimensions and mass, making the contact between the base of the panels and the bearings more precise.

We have also concluded that the ideal slope of the walls of the fit, by friction, would be 80° (+/−1°).

It is noted that the connection between the concealed support (2) and the fit of the detachable base (1) is made solely by friction, there is no welding or riveting, and therefore the separation of detachable base (1) from the concealed support (2) can be accomplished at any time, quickly and using simple tools.

The fact that the glass support profile has a "W" shape (double U) allows greater bonding area, duplicating that section, because advantage is taken of the adhesion on both sides of each glass (double).

The glass has structural features, its components being always tempered.

The invention claimed is:

1. A removable profile structure for sliding panels, comprising at least one detachable base and a concealed support independent and able to cooperate with one another, characterized in that:

the concealed support comprises a protuberance designed to support the weight of the detachable base, said concealed support comprising at least two recesses incorporating two substantially rectangular sections, said two recesses being formed in a lowermost portion of the concealed support, wherein said protuberance comprises two flat tapered surfaces on opposite sides thereof;

the detachable base having a W-shape, said W-shape comprising at least two flat contact surfaces configured to be fit to the flat tapered surfaces of the protuberance, the fit being done by means of friction and;

when joined together the contact surfaces promote a gradual increase in stability according to a weight and a size of a panel.

2. The removable profile structure according to claim 1, wherein the detachable base supports glass elements, characterized in that the detachable base has a configuration that, upon placement of the glass elements, comprises at least four bonding areas between said detachable base and the glass elements.

3. The removable profile structure according to claim 1, characterized in that a slope of the fit between the protuberance and the detachable base is between 79° and 81°.

4. The removable profile structure according to claim 1, characterized in that the rectangular sections act as damping factor for the removable profile structure.

5. The removable profile structure according to claim 1, characterized in that the concealed support allows the placing of a pavement on part of a surface of the concealed support.

6. The removable profile structure according to claim 1, characterized in that a connection between the concealed support and the fit of the detachable base is made solely by friction, so that separation between the detachable base and the concealed support can be performed easily.

* * * * *